US010413907B2

(12) United States Patent
Holl

(10) Patent No.: US 10,413,907 B2
(45) Date of Patent: Sep. 17, 2019

(54) COUNTER-ROTATING PINNED DISC MILL

(71) Applicant: HAMBURG DRESDNER MASCHINENFABRIKEN GMBH, Dresden (DE)

(72) Inventor: Wolfgang Holl, Guderhandviertel (DE)

(73) Assignee: HAMBURG DRESDNER MASCHINENFABRIKEN VERWALTUNSGESELLSCHAFT MBH, Dresden (DE)

( * ) Notice: Subject to any disclaimer, the term of this patent is extended or adjusted under 35 U.S.C. 154(b) by 231 days.

(21) Appl. No.: 15/115,696

(22) PCT Filed: Jan. 14, 2015

(86) PCT No.: PCT/EP2015/050542
§ 371 (c)(1),
(2) Date: Aug. 1, 2016

(87) PCT Pub. No.: WO2015/121012
PCT Pub. Date: Aug. 20, 2015

(65) Prior Publication Data

US 2017/0165675 A1 Jun. 15, 2017

(30) Foreign Application Priority Data

Feb. 13, 2014 (DE) ..... 10 2014 101 786.2

(51) Int. Cl.
*B02C 13/20* (2006.01)
*B02C 13/22* (2006.01)
(Continued)

(52) U.S. Cl.
CPC ..... *B02C 13/205* (2013.01); *B02C 13/22* (2013.01); *B02C 13/282* (2013.01); *B02C 13/286* (2013.01); *B02C 2013/28618* (2013.01)

(58) Field of Classification Search
CPC ..... B02C 13/22; B02C 13/205; B02C 13/24; B02C 13/26; B02C 13/282; B02C 13/286; B02C 13/30; B02C 2013/2812; B02C 7/00
(Continued)

(56) References Cited

U.S. PATENT DOCUMENTS 2,502,022 A * 3/1950 Paul ..... B02C 13/205 241/163
2,539,775 A 1/1951 Gordon
(Continued)

FOREIGN PATENT DOCUMENTS

DE 28 28 029 A1 11/1979
DE 35 90 668 C2 10/1990
(Continued)

*Primary Examiner* — Shelley M Self
*Assistant Examiner* — Katie L. Parr
(74) *Attorney, Agent, or Firm* — Norman B. Thot

(57) ABSTRACT

A counter-rotating pin mill for grinding food products includes a housing assembly comprising a first and a second housing part. A first and a second grinding shaft are arranged coaxially in the housing assembly on a grinding axis. A first grinding disk is arranged on an end of the first grinding shaft. A second grinding disk is arranged on an end of the second grinding shaft. The first and the second grinding disks are parallel to each other. A bearing device is formed by at least two slide assemblies arranged parallel with the grinding axis in the first housing part. The at least two slide assemblies comprises a slide bushing arranged in the first housing part and a slide axle guided in the slide bushing and being connected with the second housing part. The first and/or the second housing part is displaceable along the grinding axis via the bearing device.

7 Claims, 3 Drawing Sheets

(51) Int. Cl.
*B02C 13/282* (2006.01)
*B02C 13/286* (2006.01)

(58) Field of Classification Search
USPC ... 241/154, 185.5, 188.1, 188.2, 230, 285.1, 241/285.2, 285.3, 237
See application file for complete search history.

(56) References Cited

U.S. PATENT DOCUMENTS 2,623,700 A * 12/1952 Scherer ..... B02C 13/22 241/187
4,226,375 A 10/1980 Cameron
4,269,363 A * 5/1981 Entzmann ..... B02C 13/22 241/187
4,366,929 A * 1/1983 de los Santos ..... B02C 13/205 241/152.1
4,378,911 A 4/1983 Adams et al.
4,522,342 A * 6/1985 Munschenborn ..... B02C 13/22 241/188.2
4,736,897 A 4/1988 Reemet et al.
4,891,038 A * 1/1990 Nickel ..... B02C 13/205 474/166
5,580,009 A * 12/1996 Kennedy ..... B02C 18/142 241/236
7,841,552 B2 * 11/2010 Frangenberg ..... B02C 4/02 241/230
2001/0048041 A1 12/2001 Nakazato
2007/0210196 A1 * 9/2007 Tamura ..... B02C 13/10 241/277

FOREIGN PATENT DOCUMENTS

EP 0 296 791 A2 12/1988
JP 2001-334158 A 12/2001
JP 4452046 B2 4/2010
TW M273392 8/2005
WO WO 93/04780 A1 3/1993
WO WO 2013/085478 A1 6/2013

* cited by examiner

COUNTER-ROTATING PINNED DISC MILL

CROSS REFERENCE TO PRIOR APPLICATIONS

This application is a U.S. National Phase application under 35 U.S.C. § 371 of International Application No. PCT/EP2015/050542, filed on Jan. 14, 2015 and which claims benefit to German Patent Application No. 10 2014 101 786.2, filed on Feb. 13, 2014. The International Application was published in German on Aug. 20, 2015 as WO 2015/121012 A1 under PCT Article 21(2).

FIELD

The present invention relates to a counter-rotating pin mill, in particular for grinding food products.

BACKGROUND

Pin mills are used to grind various types of bulk goods. The material to be ground is thereby most often introduced near the axis into a grinding space between two coaxially arranged grinding discs. The grinding discs have grinding pins alternately arranged in concentric circles. The material introduced for grinding is transported outward due to the rotation of the grinding disc and is shredded by the grinding pins of the two grinding discs moving past each other until the desired particle size is reached. Due to the use of two instead of one driven grinding disc in counter-rotating pin mills, the relative speed of the pins moving in opposite directions doubles, whereby a better grinding is achieved. Counter-rotating pin mills are often used to grind food products. Strict legal regulations (regarding hygiene) exist for the processing of food products. For example, it is necessary to clean the grinding space of pin mills regularly and most often manually without using means harmful to health. It is thereby not possible to open the grinding housing using a simple pivot mechanism where one grinding disc is attached to one housing part due to the large diameter of the interengaging grinding discs and the grinding pins rotating close to each other. The grinding pins would contact each other and would be bent.

WO 93/04780 A1 describes an installation for grinding grain which comprises a pin mill with two grinding discs driven in a counter-rotating manner. An opening of the housing for cleaning purposes is not described.

DE 28 28 029 A1 describes an installation for grinding hop which also comprises a counter-rotating pin mill. This pin mill has a one-sided axial material supply as well as a housing divided into two parts in the grinding plane vertically to the grinding axis. The exact opening mechanism is not described.

U.S. Pat. No. 4,378,911 A describes a cage mill for grinding ore which is of a two-part design and has a rail structure arranged in the base as well as a drive unit that allows the two housing halves to be moved apart.

WO 2013/085476 A1 describes a grinding device with two coaxially arranged hollow grinding shafts by which organic bulk material is supplied to the grinding space, wherein the inner ends of the grinding shafts are provided with mutually parallel grinding discs having grinding members arranged on concentric circular paths. It is very difficult, especially with counter-rotating pin mills having a two-side axial supply, to access the grinding space for cleaning or maintenance without having to perform (both before and thereafter) extensive dismantling and assembly work. The grinding material supply devices and the drives must be separated from the housing parts in an intricate manner. The prior art does not disclose any satisfactory solution.

SUMMARY

An aspect of the present invention is to provide a counter-rotating pin mill, in particular for grinding food products, which can be opened in a simple manner and wide enough to allow for a particularly simple cleaning and maintenance of the grinding space, the grinding shafts, and the grinding discs, without the grinding pins of opposing grinding discs contact each other when the housing is closed so that they bend, and without the grinding pins, based on bending moments which primarily occur in the open state due to the weight of the second housing part, cause the two housing halves and the two grinding shafts to cant.

In an embodiment, the present invention provides a counter-rotating pin mill for grinding food products which includes a housing assembly comprising a first housing part and a second housing part. A first grinding shaft and a second grinding shaft are arranged in the housing assembly coaxially with respect to each other on a grinding axis. At least one of the first grinding shaft and the second grinding shaft comprises a grinding material inlet which is hollow so that a shaft grinding material can be supplied to a grinding space. A first grinding disk is arranged on an end of the first grinding shaft. A second grinding disk is arranged on an end of the second grinding shaft. The first grinding disk and the second grinding disk are arranged in parallel with respect to each other. The shaft grinding material is discharged from the grinding space through a grinding material outlet. A bearing device is formed by at least two slide assemblies arranged in parallel with the grinding axis and arranged in the first housing part. Each of the at least two slide assemblies comprises a slide bushing arranged in the first housing part and a slide axle guided in the slide bushing and being fixedly connected with the second housing part. At least one of the first housing part and the second housing part is configured to be displaceable along the grinding axis via the bearing device

BRIEF DESCRIPTION OF THE DRAWINGS

The present invention is described in greater detail below on the basis of embodiments and of the drawings in which.

DETAILED DESCRIPTION

Figure 1:
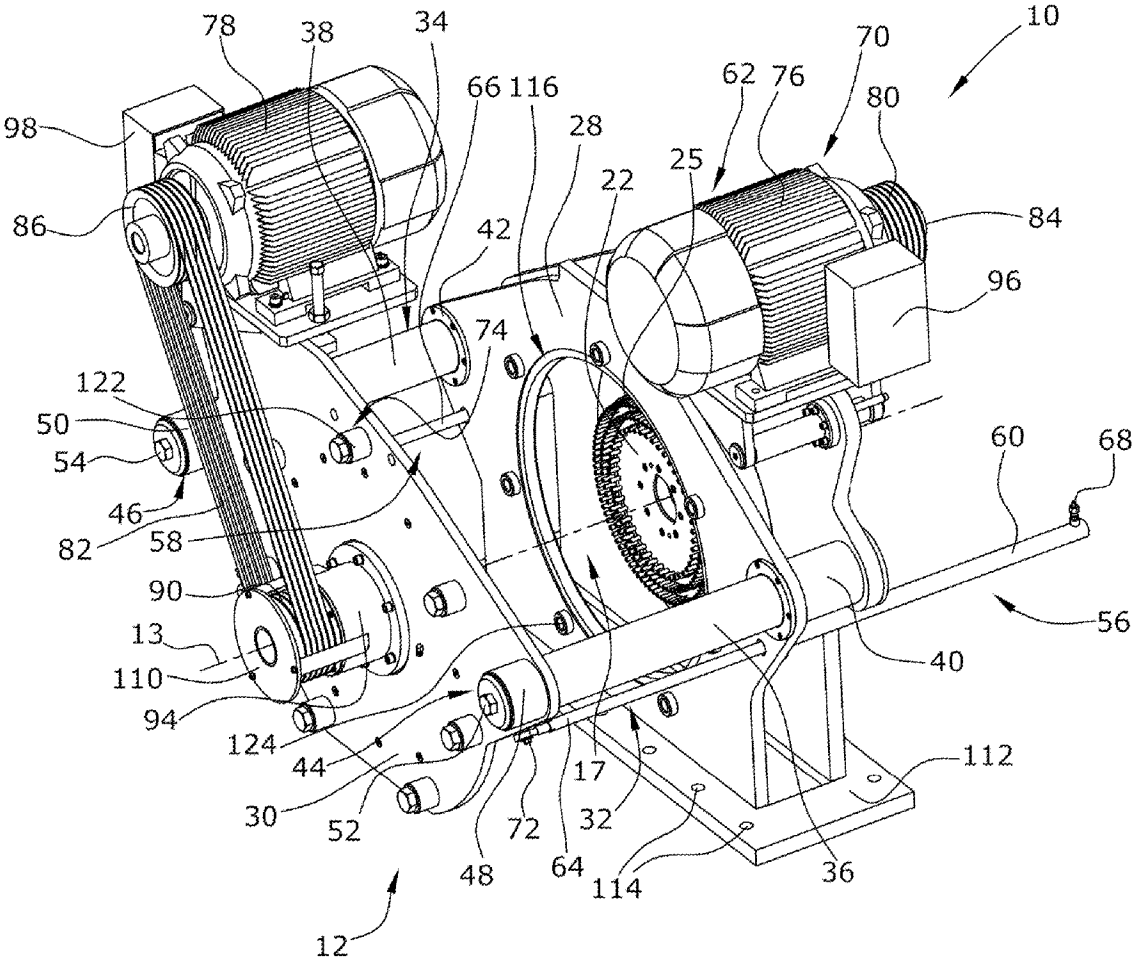
FIG. 1 shows a perspective view of a pin mill of the present invention in the open state.

In an embodiment of the present invention, at least one housing part is designed to be displaceable along the grinding axis via a bearing, the bearing being formed by at least two slide assemblies arranged parallel to the grinding axis, which assemblies are provided in the first housing part, wherein the slide assemblies comprise slide bushings arranged in the first housing with slide axles guided therein and fixedly connected with the second housing part.

The two housing parts can thus be simply pulled apart, while the coaxial arrangement of the grinding shafts and thus of the grinding discs cannot thereby be changed. As a consequence, when closing the housing, there is no risk of the grinding pins of the opposing grinding discs contacting each other and becoming bent thereby. A very good accessibility of the grinding space is further maintained by using only two slide assemblies.

The use of slide bushings with a certain axial length makes it possible to effectively absorb the bending moments that occur primarily in the open state due to the weight of the second housing part.

In an embodiment of the present invention, the slide assemblies can, for example, comprise hydraulically driven positioning assemblies. Using these assemblies, the housing can be opened and closed in a simple manner without having to manually move the heavy housing halves.

In an embodiment of the present invention, each housing part can, for example, have a drive fixedly connected therewith, which drive is operatively connected with the grinding shaft via a drive belt and via a first drive-side belt pulley and a second belt pulley on the side of the grinding shaft. This embodiment makes it possible to use two independent drives to adjust the sense of rotation and the speed of rotation to the material to be ground and to the desired grinding result. Due to the connection via a drive belt, it becomes possible to supply the grinding material in a particular manner in the axial direction through the shafts.

In an embodiment of the present invention, at least one grinding shaft can, for example, have its drive-side end provided with a grinding material supply device which is fixedly connected with the respective hollow grinding shaft via grinding material flanges. By a permanent fixed connection between the respective grinding material supply device and the respective housing part, it is possible to open the housing in a simple manner without having to detach the grinding material supply device from the grinding material flange. A permanent connection between the respective grinding shafts and the drives also reduces the effort necessary to open the housing.

In an embodiment of the present invention, at least one grinding material supply device can, for example, be arranged for a relative movement with respect to the respective housing part. Due to the fact that a part of the grinding material supply device is arranged coaxially to the respective hollow grinding shaft so as to be axially displaceable therein, the grinding material supply devices can remain fixedly connected with the first housing half or the ground.

In an embodiment of the present invention, the pin mill can, for example, have cavities for a tempering medium. A heating or cooling medium may respectively be conveyed therethrough so that an optimal processing temperature for the grinding material can be reached and maintained.

A counter-rotating pin mill is provided, in particular for grinding food products, which pin mill can be opened wide in a fast and simple manner so that the grinding space with the hollow grinding shafts and the grinding discs is easily accessible and easy to clean. After cleaning, the pin mill can be closed in a simple manner without the risk of damaging the grinding teeth of the grinding discs due to non-coaxial grinding shafts.

The following is a detailed explanation of the device according to the present invention with reference to the drawings.

FIG. 1 illustrates a counter-rotating pin mill 10 according to the present invention. The counter-rotating pin mill 10 has a housing assembly 12 of stainless steel consisting of two housing parts 28, 30 forming a grinding space 17. The first housing part 28 has a bottom-side base plate 112 which is fixedly connected with the ground or base structures (not illustrated) via the through holes 114 using a fastening device (not illustrated). In each housing part 28, 30, a respective hollow grinding shaft 14, 16 is arranged coaxially to a grinding axis 13.

Figure 2:
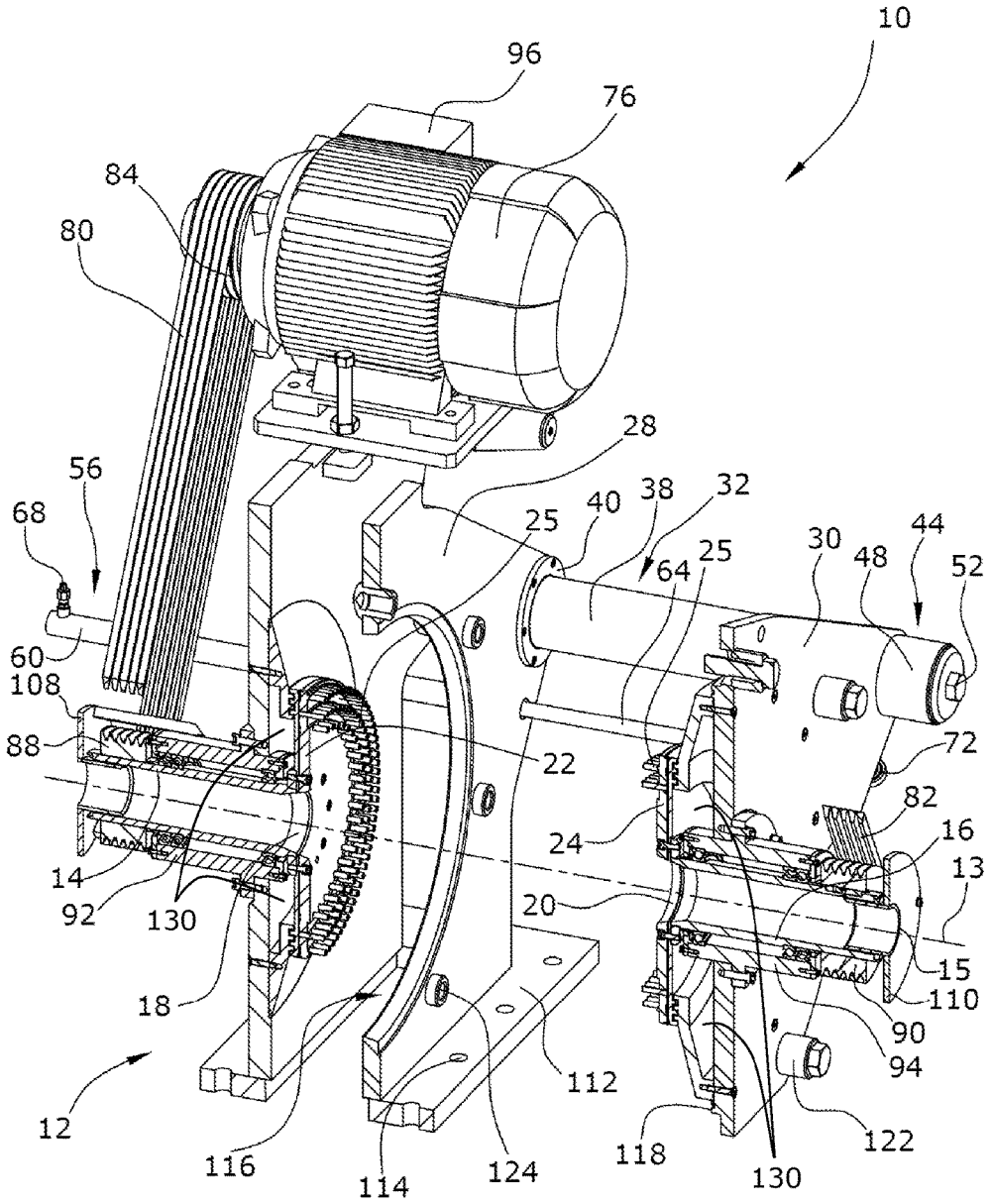
FIG. 2 shows a vertical section along the grinding axis of a pin mill of the present invention in the open state shown in perspective view.
Figure 3:
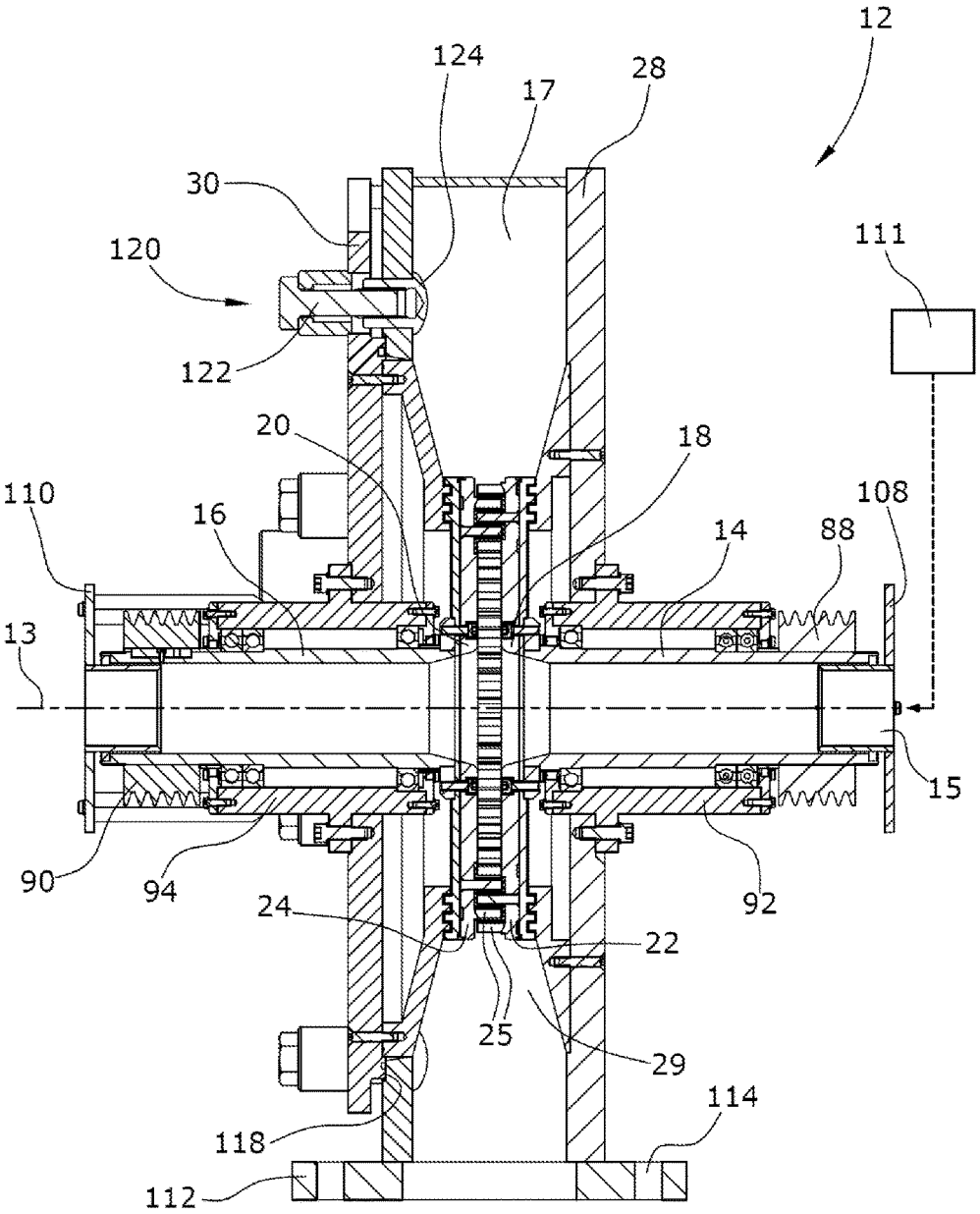
FIG. 3 shows a vertical section along the grinding axis 13 of a pin mill of the present invention.

As can be seen particularly well in the sectional view in FIG. 2, the ends 18, 20 of the grinding shafts 14, 16 facing each other have mutually parallel grinding discs 22, 24 fixed thereon by a fastening device, the grinding discs 22, 24 being provided with alternating concentrically arranged grinding pins 25. The grinding pins 25 may either be formed integrally with the grinding discs 22, 24 or they may also be formed as individual grinding pins 25 provided with threads and arranged in corresponding threaded bores or press-fitted in corresponding through-bores in the grinding discs 22, 24 with which they are fixedly connected. The grinding shafts 14, 16 are, as can be seen in FIG. 3, each supported in bearing blocks in bearing housings 92, 94 for rotation about the grinding axis 13 and have belt pulleys 88, 90 on the side of the grinding shaft, the belt pulleys 88, 90 being fixedly connected with the outer ends thereof. Drive belts 80, 82 operatively connect each of the belt pulleys 88, 90 on the side of the grinding shaft with the drives 76, 78 via drive-side belt pulleys 84, 86. The drives 76, 78 are fixedly connected with a respective housing part 28, 30 by a fastening device. Both drives 76, 78 have control devices 96, 98 via which the sense of rotation and the rotational speed of the respective drives 76, 78 and the grinding discs 22, 24 connected therewith can be adjusted. On the drive-side ends of the grinding shafts 14, 16, grinding material flanges 108, 110 are arranged that are fixedly connected with the bearing housings 92, 94, with a grinding material supply device (not illustrated) being connected with the flanges. In addition, the first housing part 28 has a tangential grinding material outlet 29 and a circular opening 116 arranged coaxial to the grinding axis 13, the diameter of the circular opening 116 being larger than the diameter of the second grinding disc 24. The housing parts of the second housing part 30 that surround the circular opening 116 are designed as a thickened sealing surface 118 formed in the direction of the first housing part 28. Two-part closure assemblies 120 are arranged equidistantly from each other and at the same distance from the grinding axis 13.

It is particularly well visible in the sectional view shown in FIG. 3 that each closure assembly 120 comprises a screw assembly 122 in the second housing part 30, arranged for rotation in parallel with the grinding axis 13, and a corresponding thread assembly 124 fixedly arranged in the first housing part 28. The two housing parts 28, 30 are connected with each other via slide assemblies 32, 34. The slide assemblies 32, 34 each have slide bushings 40, 42 arranged in the first housing part 28, the rotation axes of the slide bushings 40, 42 being oriented parallel to the grinding axis 13, and in which slide axles 36, 38 are arranged for displacement therein, which slide axles 36, 38 are fixedly connected with the second housing part 30. The slide assemblies 32, 34 further comprise rotationally symmetrical damping elements 44, 46 arranged coaxially to the slide axles 36, 38. They each have a cylindrical buffer block 48, 50 which, using fastening devices 52, 54 (only one of which is illustrated), is arranged on the drive-side end of the second housing part 30 to be coaxial to the slide axles 36, 38. Hydraulically actuable positioning assemblies 56, 58 are each located in parallel with and beside the slide assemblies 32, 34. Each positioning assembly 56, 58 has an positioning cylinder 60, 62 fixedly connected with the first housing part 28, and a movable piston 64, 66 fixedly connected with the second housing part 30 by via a fastening device 72, 74. A hydraulic port 68, 70 is also provided at the outer end of the positioning cylinder 60, 62, to which hydraulic port 68, 70 a hydraulic unit (not illustrated) is connected. Each of positioning cylinder 62, hydraulic port 70, and fastening device 74 are covered by other elements and are thus not shown in the drawings.

In regular working operation of a pin mill 10 of the present invention, both housing parts 28, 30 are connected fixedly and fluid-tightly up to an overpressure of 10 bar. For this purpose, the positioning assemblies 56, 58 are hydraulically actuated to be locked in their minimal end positions. The closure assemblies 120 are further closed by the screw assembly 122 in the respective thread assembly 124. Through the opposing coaxially arranged grinding shafts 14, 16, grinding material is supplied, via a hollow grinding material inlet 15 (only one if which is shown in FIGS. 2 and 3), to the grinding space 17 via grinding material supply devices 111 (only one of which is shown in FIG. 3) arranged on both sides, which devices are fixedly connected with the respective grinding material flanges 108, 110. This may be achieved in different ways. For example, with humid or sticky material, transport may be performed using screw conveyors reaching up to the grinding space 17 and rotating in the grinding shafts 14, 16. As an alternative, pneumatic conveying may also be feasible, wherein a gaseous conveying medium is added to the grinding material so that the two grinding material flows meet at high velocities in the middle of the grinding space 17. A preliminary shredding of the materials to be ground is thereby already achieved during the supply of the grinding material.

The grinding discs 22, 24 are rotated in opposite directions by the grinding shafts 14, 16 rotated by the drives 76, 78 via the drive-side belt pulleys 84, 86, the drive belts 80, 82 and the belt pulleys 88, 90 on the side of the grinding shaft. Due to the centrifugal forces acting on the grinding material, the grinding material is ground finely between the grinding pins and may be discharged, after passing through the grinding region, via the grinding material outlet 29 which can, for example, be arranged in the bottom region of the grinding space 17.

If it is necessary to open the housing assembly 12, for example, for a regular cleaning of the grinding space 17 or to replace individual grinding pins 25, after switching off the drives, the closure assemblies 120 are first opened manually, whereupon the two housing parts 28, 30 are moved apart along the grinding axis using the hydraulically actuated positioning assemblies 56, 58. In doing so, the second housing part with the connected slide axles 36, 38 slides through the slide bushings 40, 42 until the positioning assemblies 56, 58 have reached their maximum extended position. The drives 76, 78 and the grinding material supply devices remain fixedly connected with the respective housing parts. Cleaning and maintenance work may be carried out in the grinding space 17 now easily accessible through the circular opening 116. When the work is completed, the two housing parts 28, 30 may be moved together again using the positioning assembly 56, 58, until the sealing surface 118 of the second housing part 30 contacts the opposite surface of the first housing part 28 and tightly closes the same after the opposing screw assemblies 122 are threaded into the thread assemblies 124. The grinding process may be restarted immediately.

It should be clear that the scope of protection of the present application is not limited to the embodiment described. In particular, it is possible to use pneumatically or electrically driven positioning assemblies 56, 58 instead of hydraulically driven positioning assemblies 56, 58. A purely manual separation of the two housing parts 28, 30 is also conceivable.

In order to grind the grinding material at a certain temperature, it is further conceivable to heat or cool the grinding discs 22, 24 via circulating media such as nitrogen in cavities 130 of the discs, and to thereby influence the grinding temperature.

It is also conceivable to design the housing assembly 12 so that the sealing surface 118 of the two housing parts 28, 30 is arranged in the grinding plane.

The cylindrical grinding pins 25 may also have another geometrical shape to achieve a desired grinding result.

The present invention is not limited to embodiments described herein; reference should be had to the appended claims.

What is claimed is:

1. A counter-rotating pin mill for grinding food products, the counter-rotating pin mill comprising:

a housing assembly comprising a first housing part and a second housing part;

a first grinding shaft and a second grinding shaft arranged in the housing assembly coaxially with respect to each other on a grinding axis, at least one of the first grinding shaft and the second grinding shaft comprising a grinding material inlet which is hollow so that a shaft grinding material can be supplied to a grinding space;

a first grinding disk arranged on an end of the first grinding shaft;

a second grinding disk arranged on an end of the second grinding shaft, the first grinding disk and the second grinding disk being arranged in parallel with respect to each other;

a grinding material outlet through which the shaft grinding material is discharged from the grinding space; and a bearing device formed by at least two slide assemblies arranged in parallel with the grinding axis and arranged in the first housing part, each of the at least two slide assemblies comprising a slide bushing arranged entirely within the first housing part and a slide axle guided entirely within the slide bushing and being fixedly connected with the second housing part, wherein, at least one of the first housing part and the second housing part is configured to be displaceable along the grinding axis via the bearing device.

2. The counter-rotating pin mill as recited in claim 1, wherein each of the at least two slide assemblies comprise a positioning assembly which is hydraulically driven.

3. The counter-rotating pin mill as recited in claim 1, wherein, the first housing part comprises a first drive fixedly connected therewith, the first drive being operatively connected with the first grinding shaft via a first drive belt, a first drive-side belt pulley, and a first belt pulley arranged on the side of the grinding shaft, and the second housing part comprises a second drive fixedly connected therewith, the second drive being operatively connected with the second grinding shaft via a second drive belt, a second drive-side belt pulley, and a second belt pulley arranged on the side of the grinding shaft.

4. The counter-rotating pin mill as recited in claim 1, further comprising:

a grinding material flange; and a grinding material supply device, wherein, the grinding material supply device is arranged at a drive side end of at least one of the first grinding shaft and the second grinding shaft, and the grinding material supply device is connected with the respective first grinding shaft or the second grinding shaft via the grinding material flange.

5. The counter-rotating pin mill as recited in claim 4, wherein the grinding material supply device is fixedly connected with the first housing part or with the second housing part so that no relative movement is possible between the grinding material supply device and the first housing part or the second housing part.

6. The counter-rotating pin mill as recited in claim 4, wherein the grinding material supply device is movable with respect to the first housing part or with respect to the second housing part.

7. The counter-rotating pin mill as recited in claim 1, wherein the housing assembly further comprises cavities for a tempering medium.

* * * * *